US008162098B2

(12) United States Patent
Emery et al.

(10) Patent No.: US 8,162,098 B2
(45) Date of Patent: Apr. 24, 2012

(54) TUNABLE ACOUSTIC REFLECTOR

(75) Inventors: David Emery, Salisbury (GB); Duncan Paul Williams, Salisbury (GB); John Darren Smith, Salisbury (GB)

(73) Assignee: The Secretary of State for Defence, Salisbury, Wiltshire (GB)

( * ) Notice: Subject to any disclaimer, the term of this patent is extended or adjusted under 35 U.S.C. 154(b) by 0 days.

(21) Appl. No.: 12/736,394

(22) PCT Filed: Apr. 2, 2009

(86) PCT No.: PCT/GB2009/000885

§ 371 (c)(1),
(2), (4) Date: Dec. 1, 2010

(87) PCT Pub. No.: WO2009/122184

PCT Pub. Date: Oct. 8, 2009

(65) Prior Publication Data

US 2011/0100745 A1 May 5, 2011

(30) Foreign Application Priority Data

Apr. 2, 2008 (GB) ..... 0805938.8
Oct. 13, 2008 (GB) ..... 0818724.7

(51) Int. Cl.
*G10K 11/00* (2006.01)

(52) U.S. Cl. ..... 181/175; 367/151; 310/311

(58) Field of Classification Search ..... 181/175; 367/175, 151; 310/311
See application file for complete search history.

(56) References Cited

U.S. PATENT DOCUMENTS

| | | | | | |
|---|---|---|---|---|---|
| 2,943,296 | A * | 6/1960 | Fryklund | ..... | 73/290 V |
| 3,409,868 | A | 11/1968 | Salathiel | | |
| 3,599,747 | A * | 8/1971 | Hansen et al. | ..... | 181/212 |
| 3,723,962 | A * | 3/1973 | Hotchner | ..... | 181/125 |
| 4,836,328 | A * | 6/1989 | Ferralli | ..... | 181/155 |
| 5,365,024 | A * | 11/1994 | Hasegawa et al. | ..... | 181/176 |
| 5,615,176 | A * | 3/1997 | LaCarrubba | ..... | 367/151 |
| 5,822,272 | A | 10/1998 | Ream | | |
| 2008/0111448 | A1* | 5/2008 | Smith et al. | ..... | 310/311 |
| 2009/0288910 | A1* | 11/2009 | Krebs et al. | ..... | 181/175 |

FOREIGN PATENT DOCUMENTS

| | | |
|---|---|---|
| DE | 28 55 207 | 8/1979 |
| GB | 1 465 932 | 3/1977 |
| GB | 2 422 282 | 7/2006 |
| GB | 2 437 016 | 10/2007 |
| WO | WO 2006/075167 | 7/2006 |

OTHER PUBLICATIONS

International Search Report for PCT/GB2009/000885, mailed Oct. 2, 2009.
International Preliminary Report on Patentability mailed Oct. 14, 2010 in PCT/GB2009/000885.
GB Search Report dated Jul. 9, 2008 in GB 0805938.8.
UK Combined Search and Examination Report dated Jul. 31, 2009 for GB 0905722.5.

* cited by examiner

*Primary Examiner* — Forrest M Phillips
(74) *Attorney, Agent, or Firm* — Nixon & Vanderhye P.C.

(57) ABSTRACT

An acoustic reflector suitable for use as a reflective target for navigational aids and for location and re-location applications. The acoustic reflector comprises a shell arranged to surround a solid core. The shell is adapted to transmit acoustic waves incident thereon into the core. Within the core the acoustic waves are focused before being reflected from an opposing side of the shell to provide a reflected acoustic wave. The shell has at least two areas of transmissibility such that the waves incident on the shell follow separate paths within the core before being re-radiated and combining constructively to provide an enhanced reflected acoustic wave at one or more pre-determined frequencies.

13 Claims, 4 Drawing Sheets

TUNABLE ACOUSTIC REFLECTOR

This application is the U.S. national phase of International Application No. PCT/GB2009/000885 filed 2 Apr. 2009, which designated the U.S. and claims priority to GB Application No. 0805938.8 filed 2 Apr. 2008; and GB Application No. 0818724.7 filed 13 Oct. 2008, the entire contents of each of which are hereby incorporated by reference.

The present invention relates to acoustic reflectors and particularly to underwater reflective targets used as navigational aids and for location and re-location.

Underwater reflective targets are typically acoustic reflectors which are generally used in sonar systems such as, for example, for tagging underwater structures. Relocation devices are used, for example, to identify pipelines, cables and mines and also in the fishing industry to acoustically mark nets.

In order to be effective an acoustic reflector needs to be easily distinguishable from background features and surrounding clutter and it is therefore desirable for such reflective targets to (a) be capable of producing a strong reflected acoustic output response (i.e. high target strength) relative to the strength of the acoustic waves reflected off background features and surrounding clutter and (b) have acoustic characteristics that enable it to be discriminated from other (false) targets.

Enhanced reflection of acoustic waves from a target is currently achieved by refracting input acoustic waves, incident on a side of a spherical shell, such that they are focused along an input path onto an opposing side of the shell from which they are then reflected and emitted by the reflector as an output reflected response. Alternatively, the input acoustic waves may be reflected more than once from an opposing side of the shell of the reflector before being emitted as an output reflected wave.

Known underwater reflective targets comprise a fluid-filled spherical shell. Such fluid-filled spherical shell targets have high target strengths when the selected fluid has a sound speed of about 840 $ms^{-1}$. This is currently achieved by using chlorofluorocarbons (CFCs) as the fluid inside the shell. Such liquids are generally undesirable organic solvents, which are toxic and ozone-depleting chemicals. Fluid filled spherical shell reflective targets are therefore disadvantaged because use of such materials is restricted due to their potential to harm the environment as a result of the risk of the fluid leaking into, and polluting, the surrounding environment. Furthermore, fluid filled shell reflective targets are relatively difficult and expensive to manufacture.

Another known acoustic reflector is a triplane reflector which typically comprises three orthogonal reflective planes which intersect at a common origin. However, such reflectors may require a coating to make them acoustically reflective at frequencies of interest and for use in marine environments and, although capable of a high target strength, the reflective properties of the coating material are prone to variation with pressure due to depth under water. Furthermore, triplane reflectors are disadvantaged in that their reflectivity is dependent on, and restricted to, their aspect, wherein variations of greater than 6 dB of target strength can occur at different angles.

Acoustic reflector tags suitable for attaching to, locating, tracking and monitoring marine mammals such as seals, dolphins and whales for research purposes, are also required but such tags need to be lightweight and small in size so as not to inhibit the animal in any way. The abovementioned known reflectors are not suitable for such applications. As mentioned above, the liquid filled sphere reflectors rely on toxic materials and are therefore considered to be potentially harmful to an animal to which it is attached and the surrounding environment in which the animal lives. The triplane reflector is not omni-directional but is, instead, dependent on, and restricted to, its aspect which is unhelpful.

Applicant's UK patent No. 2,347,016 discloses and claims an acoustic reflector comprising a shell having a wall arranged to surround a core, said shell being capable of transmitting acoustic waves incident on the shell into the core to be focused and reflected from an area of the shell located opposite to the area of incidence so as to provide a reflected acoustic signal output from the reflector, characterised in that the core is in the form of a sphere or right cylinder and is formed of one or more concentric layers of a solid material having a wave speed of from 840 to 1500 $ms^{-1}$ and that the shell is dimensioned relative to the core such that a portion of the acoustic waves incident on the shell are coupled into the shell wall and guided therein around the circumference of the shell and then re-radiated to combine constructively with the said reflected acoustic signal output so as to provide an enhanced reflected acoustic signal output.

This reflector is durable, non-toxic, small in size and relatively easy and inexpensive to manufacture.

It was noted that the reflector may be in the shape of either a sphere or a cylinder with the circular cross section orthogonal to the generator. In the latter case the reflector would be in the form of a long continuous system, ie a rope, with high sonar returns coming from specular glints from those parts of the rope which are disposed at right angles to the direction of travel of the acoustic signal.

The core could be formed from a single solid material. Alternatively, the core may comprise two or more layers of different materials where, for a particular selected frequency of the acoustic waves, these would provide either more effective focussing of the incoming waves and/or lower attenuation within the material so as to result, overall, in a stronger output signal. Descriptions of suitable core materials are given noting that in the operating region they should not suffer from high absorption of acoustic energy.

The shell may be formed of a rigid material, such as, for example, a glass reinforced plastics (GRP) material, particularly a glass filled nylon such as 50% glass filled Nylon 66 or 40% glass filled semi-aromatic polyamide, or steel and may be dimensioned such that its thickness is approximately one-tenth of the radius of the core. However, the derivation of the appropriate relationship between these parameters in relation to the characteristics of the materials used for the core and shell will be readily understood by the skilled person.

The concept of combining waves transmitted through the shell of the reflector with internally focused waves could be exploited within the design of the device to provide a highly recognisable feature or features in the enhanced reflected acoustic signal output from the device. For example, the signal output might be arranged to possess a characteristic time signature or spectral content.

By appropriately adapting the sonar which is being used to detect the acoustic signal output so as to recognise the characteristic feature in the output, it then becomes possible to more readily distinguish between the signal from the reflector of the invention and background clutter and returns from other (false) targets lying in the field of view of the sonar detector being employed.

It was noted also that with appropriate manipulation of the phasing between the two returns, viz. the geometrically focused return from the core with the elastic wave return from the outer shell, it is possible to arrange for the device to demonstrate a unique frequency resonance that will "colour"

the returned echo. By this means the return from a particular reflector can be discriminated from other (false) targets in a highly cluttered environment.

Applicant has now found that by appropriate selection of dimensions and materials an acoustic reflector having the structure generally as described previously may be caused to demonstrate the property of having two or more separate transmission windows on separate areas of the shell giving rise to two or more separate focused acoustic wave paths through the core of the reflector. Such a device will provide an enhanced reflected acoustic signal output by virtue of interference between the distinct acoustic paths resulting from the separate transmission windows in the shell.

Accordingly an acoustic reflector is provided comprising a shell having a wall arranged to surround a core, said shell being capable of transmitting acoustic waves incident on the shell into the core to be focused and reflected from an area of the shell located opposite to the area of incidence so as to provide a reflected acoustic signal output from the reflector, the core being formed of one or more concentric layers of a solid material having a wave speed of from 840 to 1500 $ms^{-1}$ characterised in that the shell is dimensioned relative to the core such that incident acoustic waves are transmitted through the shell into the core along two or more distinct paths and the associated reflected signal outputs are combined constructively to provide an enhanced reflected acoustic signal output at one or more pre-determined frequencies.

The reflector is preferably in the shape of either a sphere or a cylinder with the circular cross section orthogonal to the generator. In the latter case the reflector would be in the form of a long continuous system, ie a rope, with high sonar returns coming from specular glints from those parts of the rope which are disposed at right angles to the direction of travel of the acoustic signal. Alternatively, it has been found that reflectors of the above kind can be effective if they are of ovoid (rugby ball) shape, provided that the cross section is circular.

The reflector of this invention can be tuned to a specified frequency by appropriate selection of the core diameter and the shell thickness and the respective material properties of each component. In particular it is important that the acoustic wave speed of the inner core material is such that the two focused return signals have different acoustic path lengths making constructive interference between the signals possible.

Preferably, the core is formed from a single solid material having a wave speed between 840 $ms^{-1}$ and 1300 $ms^{-1}$. Alternatively, the core may comprise two or more layers of different materials where, for a particular selected frequency of the acoustic waves, these would provide either more effective focussing of the incoming waves and/or lower attenuation within the material so as to result, overall, in a stronger output signal. Naturally, however, the complexity and costs of manufacture in the case of a layered core would be expected to be greater. Where the core is formed of two or more layers of different materials, either or both of the materials may have a wave speed of up to 1500 $ms^{-1}$.

To be suitable for use in the reflector device of the invention, the core material must be such that it exhibits a wave speed in the required range without suffering from a high absorption of acoustic energy. The core may be formed from an elastomer material such as, for example, a silicone, particularly RTV12 or RTV655 silicone rubbers from Bayer or Alsil 14401 peroxide-cured silicone rubber.

The shell may be formed of a rigid material, such as, for example, a glass reinforced plastics (GRP) material, particularly a glass filled nylon such as 50% glass filled Nylon 66 or 40% glass filled semi-aromatic polyamide, or steel and may be dimensioned such that its thickness is approximately one-tenth of the radius of the core.

In order to further influence the spectral response of the reflector, the internally focused waves can, if desired, be combined with (elastic) waves transmitted through the shell of the reflector as previously described in applicant's UK patent No. 2,437,016, so as to provide a highly recognisable feature or features in the enhanced reflected acoustic signal output from the device.

Advantage may also be taken of the feature that the signal output from a reflector according to the present invention may comprise a characteristic time signature thus enabling unique identification. In general, targets in the form of spheres can often be easily distinguished from a large number of false targets by virtue of the fact that they produce a very recognisable "tail" to the return signal (echo). This echo structure is formed as a result of multiple acoustic paths within the reflector device and has a characteristic exact period structure which is not replicated by the majority of underwater targets.

Because of the ability to produce a tailored frequency content of the echo return, the spectral response of the reflector of the invention is—to use an optical analogy—colored rather than being somewhat monochromatic as is the case with most underwater targets at the frequencies which are generally used by sonar systems. Consequently it becomes possible to very readily distinguish between signals returning from the reflector of the invention and the background clutter as well as returns from other (false) targets lying in the field of view of the sonar detector being employed.

Additionally, however, as a result of the ability to tune individual reflectors so as to produce different spectral outputs, a number of very useful applications of the devices of the invention become apparent. For example, by using a sonar system operating in dual frequency mode and tuned to two different reflector frequencies, the respective reflectors are able to act as "traffic lights" or be used to define an exclusion zone for autonomous or semi-autonomous systems or to provide navigation lanes for underwater vehicles in the form of pathways between two rows of differently tuned reflectors.

It should be noted that, because the echo return from a reflector according to the present invention is completely independent of the geometry relative to the interrogating sonar, the devices can be deployed such that only the position is important and not how the device rests on the seabed. Placing of the reflectors underwater is thus made simpler, more effective and cheaper to achieve than with other more directional devices.

As an alternative to using sonar operating in a dual frequency mode, a sonar operating in a broad band mode and exploiting the different frequency content so as to associate two different colors to respective reflectors could be used. While accepting that this might require appropriate adaptation of a conventional sonar system in order to provide a sufficient bandwidth for illumination together with an appropriate signal processing capability to enable detection of the distinct acoustic signal outputs (and thus provide an enhanced recognition capability), it is yet considered that only the latter (i.e. some development of the processing software) is actually likely to be required.

A further potential application of the reflectors of this invention would be to enable location finding with respect to a known location of one or more reflectors. This could be particularly useful for autonomous underwater vehicles (AUVs) which rely on inertial navigation systems (INS) for position finding. It is well known that the INS of such vehicles require to be recalibrated following descent of the vehicle to depth and this could be achieved by interrogation of reflectors having known spectral characteristics and known positions. To aid the identification of specific reflectors for purposes of providing a datum location, it may be convenient to set out a group of reflectors in a specific pattern and this could be in the form of a pre-prepared combination e.g. on a plate or mat. The same type of arrangement may also be useful for locating an object of interest on the seabed such as a well head or pipe valve with different numbers and/or arrangements of the reflectors being indicative of a specific object being marked.

Furthermore, it is noted that the sonar source can be mounted on any conventional carrier, such as a submarine or other manned submersible, a permanently mounted underwater sonar, a dipping sonar mounted on a boat, aircraft or helicopter, or an AUV.

In this invention an identification and recovery system for sub-sea objects includes a passive sonar reflector attached to the object, a sonar transmitter and a means to receive sonar signals reflected from the passive sonar reflector. The reception means may be located with the transmitter or at some other location. Triangulation systems are possible, in which receivers are located at three different places and the specific location of an object is identified by conventional triangulation means.

Many novel uses of such systems are possible. These include:

- marking of a specific geographic location of a submerged object or the application to an object in preparation for subsequent submergence either alone or in combination with other similar sonar reflectors/active location devices to provide an aid to location (red+green versus red+blue for example) i.e. pipelines, power cables, telephony cables, fixed equipment on the seabed;
- application to a submerged device or the application to a device in preparation for subsequent submergence which will mark the current location of the device within or at the bottom of the water column or on the seabed, i.e. the marking of cables or other devices which are moved around either freely or within certain bounds such as certain cables which move with the tide and/or current or other movable assets;
- marking underwater parts of oil or gas platforms or the remains of such platforms which could include using differently tuned reflectors as a means for identifying the ownership, function or type etc. of particular categories of underwater asset;
- marking locations which have subsea/navigational significance but where it is not necessary to attach the sonar reflector to specific equipment, for example, for shipping lanes, as in-port location aids, for wrecks or other navigation hazards such as coral reefs, underwater rocks etc.;
- marking or indicating zones of economic or commercial interest, for example national maritime boundaries for say mineral extraction rights;
- identification of high value containers lost overboard from vessels, or lost in aircraft accidents, or the location and recovery of aircraft black boxes;
- geophysical structure monitoring such as marking and monitoring the movement of mid ocean rifts;
- marking dangerous objects on the seabed for later disposal such as wrecks and mines for example.

A further potential application would be to provide means whereby the location of a diver can be tracked from a surface vessel and thus aid the provision of assistance to the diver if necessary. While diver tracking systems currently exist for this purpose, these are generally based on powered active transducers. Such transducers are relatively expensive and bulky as compared to the passive acoustic reflector of the invention and moreover require periodic re-calibration and maintenance to keep the device working reliably and correctly whereas the passive reflector should require no re-calibration or maintenance. Also, by virtue of the ability to tune individual reflectors, where more than one diver is operating from a surface craft, each diver can be individually "tagged". The reflectors can be tuned to respond to standard depth or fish-finding sonars which are widely available and relatively inexpensive.

It should be noted that the size of the acoustic reflector of this invention can be varied as desired. A larger device will give a stronger return signal but for the purposes of attachment to a diver or to a marine animal for example, a relatively small reflector (e.g. of diameter in the order of 50 to 100 mm) is preferred.

The present invention will now be described by way of example and with reference to the accompanying drawings, in which.

Figure 1:
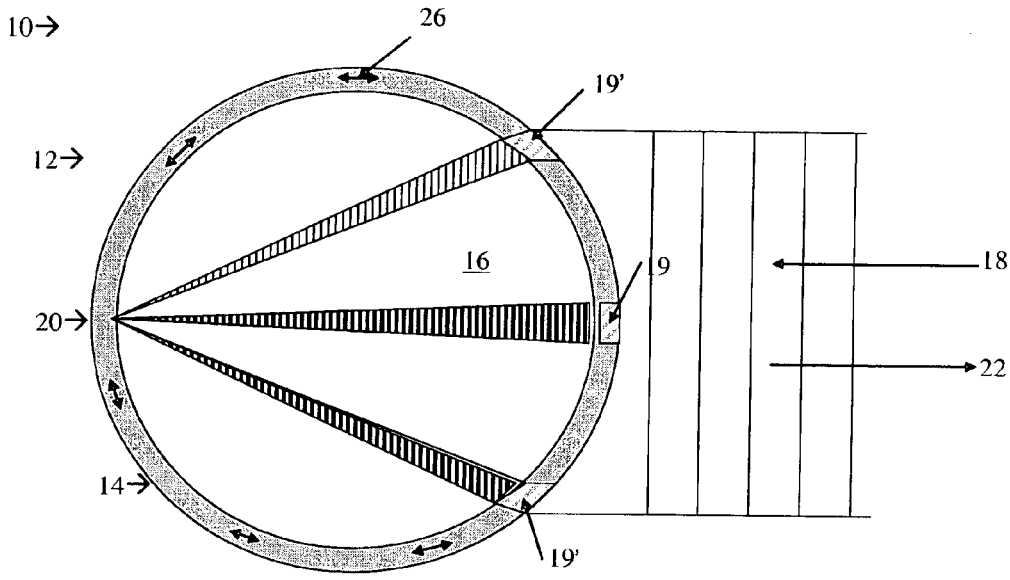
FIG. 1 is a schematic representation of a cross section through an acoustic reflector according to the present invention, showing some acoustic paths through the reflector core.

Referring to FIG. 1, an acoustic reflector 10 comprises a spherical shell 12 having a wall 14. The wall 14 surrounds a core 16. The shell 12 is formed from a rigid material such as a glass reinforced plastics (GRP) material or steel. The core 16 is formed from a solid material such as an elastomer.

Acoustic waves 18, transmitted from an acoustic source (not shown), are incident as shown on the shell 12. The properties of the shell are selected in the manner previously described such that it exhibits two regions disposed around lines of latitude of the shell which act as transmission "windows", i.e. such that the incident acoustic waves are in these regions efficiently transmitted through the shell wall 14 and into the core 16. Consequently the incident acoustic waves then follow two paths (19, 19') as they travel through the core 16 and are refracted and thereby focused onto an area 20 of the opposing side of the shell from the side on which the acoustic waves 18 are incident. The waves are then reflected back, along the same respective paths and combine together to provide an enhanced reflected acoustic signal output 22 of the reflector.

As shown in applicant's UK patent No. 2,437,016, for regions of the shell where the angle of incidence of the incoming acoustic wave is low, a portion of the incident waves 18 is coupled into the wall 14 and generates elastic waves 26 which are guided within the wall 14 around the circumference of the shell 12. Where the materials which form the shell 12 and the core 16 and the relative dimensions of the shell and core are predetermined such that the transit time of the shell wave 26 is the same as the transit time of the internal geometrically focused returning waves (19, 19'), the elastic wave travelling through the shell wall and the reflected acoustic signal output are in phase with each other and therefore combine constructively at a frequency of interest to provide a further enhanced reflected acoustic signal output (i.e. a strong target response).

Figure 2:
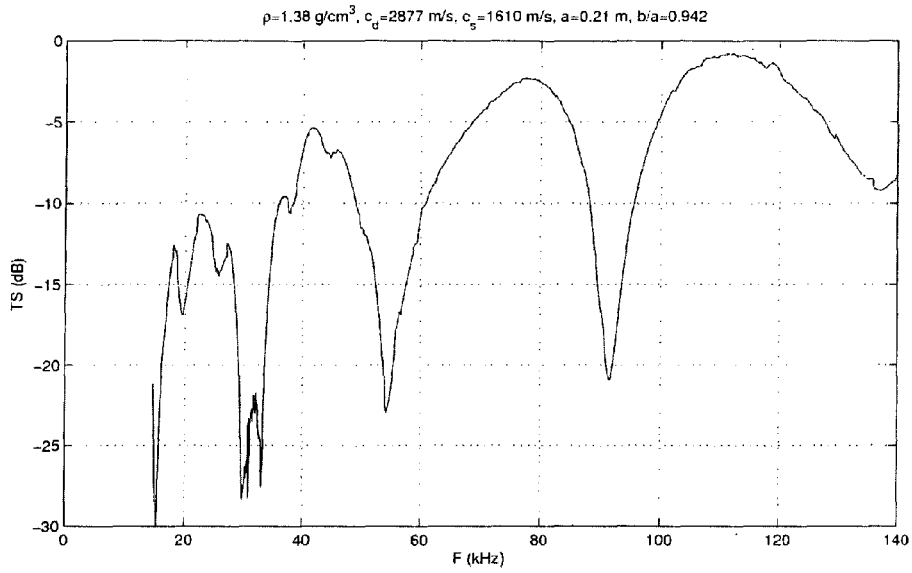
FIG. 2 is a graph showing target strength against frequency for a particular combination of shell and core materials and dimensions of an acoustic reflector according to the present invention.

FIG. 2 presents data obtained by numerical modelling, comprising the target strength (TS) for a spherical acoustic reflector according to the present invention, plotted against the frequency (F) of the incident acoustic waves. The reflector in this case is taken as comprising a silicone rubber core of density 1.0 g $cm^{-3}$ and having an acoustic wave speed of 1040 m $s^{-1}$ and a shell having a longitudinal wave speed of 2877 m $s^{-1}$, a shear wave speed of 1610 m $s^{-1}$ and a density of 1.38 g $cm^{-3}$ as appropriate to a glass reinforced polyamide material. The outer radius of the reflector is set at 210 mm and the ratio of its inner to its outer radius at 0.942:1.

As can be seen on the graph the reflector in this case demonstrates a high level of return, i.e. a relatively high target strength, at a number of frequencies lying between approximately 20 kHz and 120 kHz, specifically in the regions of 25, 40, 80 and 110 kHz.

Figure 3:
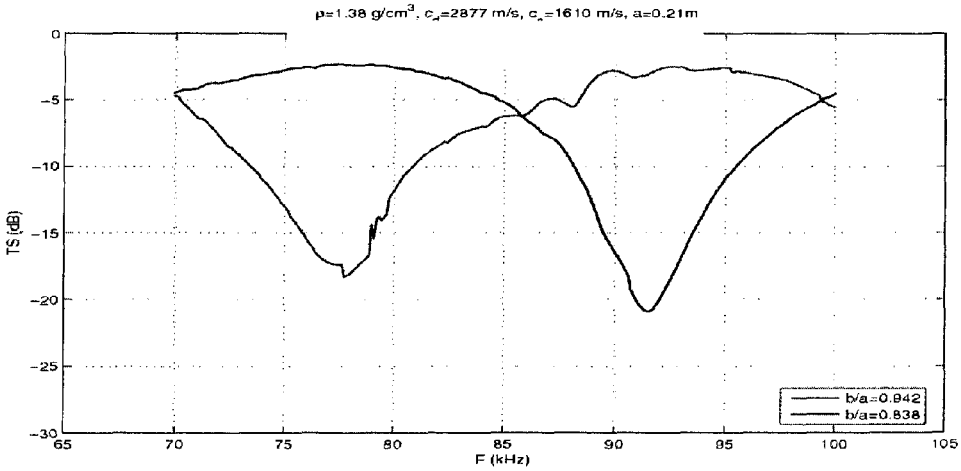
FIG. 3 is a graph of target strength against frequency for two different reflectors showing the effect of different thicknesses of shell wall on the frequency response.

The data in FIG. 3 is generated on the same basis as for FIG. 2 but shows the spectral response for two different reflectors having the same core and shell properties as for the reflector of FIG. 2 and an external radius of 210 mm but where the ratio of internal to external radii have different values (0.942 (heavy line) and 0.838 (light line) respectively, corresponding to shell thicknesses of 12 mm and 34 mm). As can be seen from FIG. 3, reflectors according to the present invention can be made in which variation of the single parameter of shell thickness results in reflectors having quite markedly different spectral responses. Further variation may be obtained, as will be well understood by the skilled addressee, by changing the material properties of the inner core and/or the outer shell of the reflector.

Figure 4:
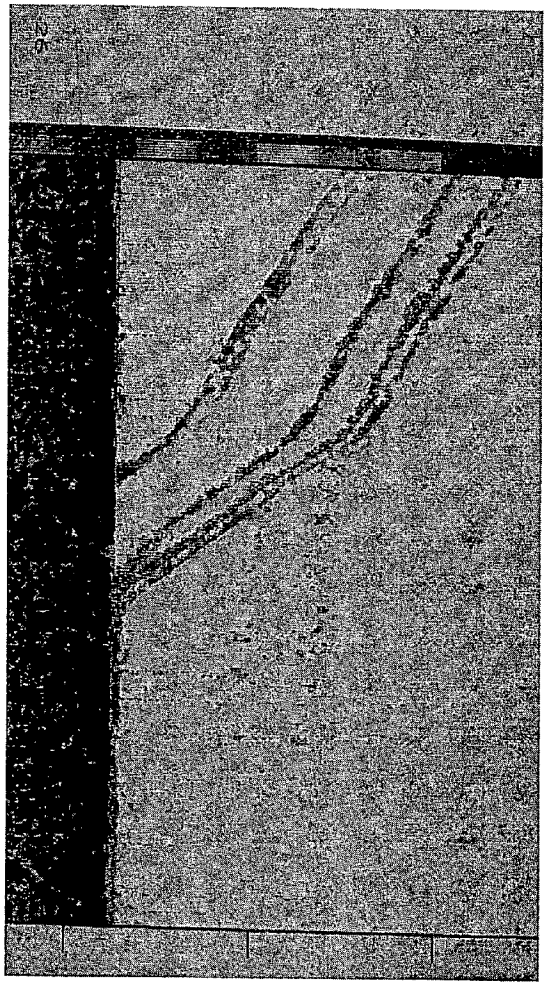
FIG. 4 is a trace obtained using a commercially available fish finder device showing a number of reflectors according to the invention descending to a sea bed location.
Figure 5:
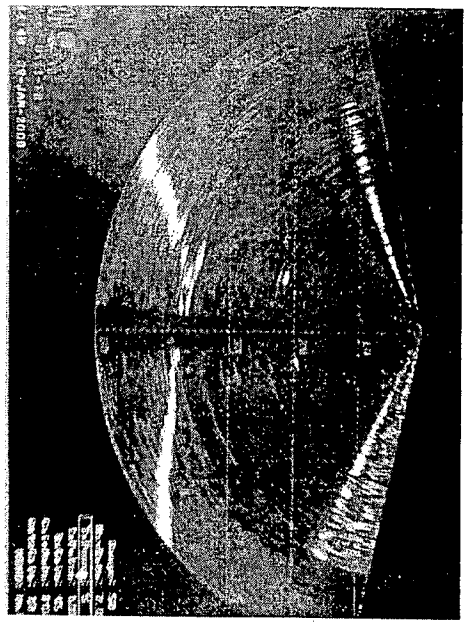
FIG. 5 is a photograph of the output from a multi-beam sonar scanning an area of sea bed with two reflectors according to the invention positioned between the surface and the sea bed.
Figure 6:
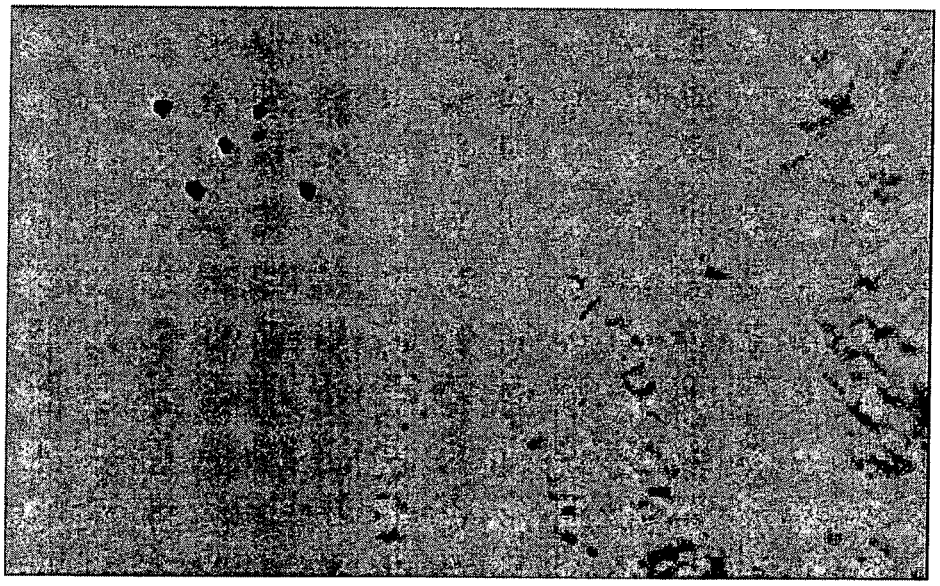
FIG. 6 is a photograph of the output from a multi-beam sonar scanning an area of sea bed with a group of five reflectors according to the invention positioned adjacent to the sea bed.

The acoustic reflectors used in obtaining the results shown in FIGS. 4 to 6 comprised an RTV12 silicone rubber core having an acoustic wave speed of 1040 m $s^{-1}$ and a glass reinforced polyamide shell.

FIG. 4 is a trace obtained of a sea trial using a number of reflectors according to the invention and a commercially available 50 kHz fish finder device in 30 m of water with a very benign sea bed. The trace is of depth against time and the positions of 5 reflectors are clearly shown as they were lowered to the sea bed.

FIG. 5 is a photograph of the output from a multi-beam RESON 8111 Seabat sonar system. This sonar was held over the bow of a vessel with the sonar head held 2 m below the water surface and the vessel was then run across an area of sea bed at a depth of 150 m with two reflectors according to the invention positioned at a depth of between 70 and 80 m above this area. The reflectors show a high response and can be readily picked out against the background noise and positioned above the sea bed response. It is possible from such traces to produce a map of the sea bed to show the sea bed topology and the location of the reflectors that are present.

FIG. 6 is a photograph of the output from a multi-beam bathometric sonar system scanning an area of sea bed with a group of five reflectors according to the invention positioned about 1 m above the sea bed. The area to the right of the reflectors shows an area of rocky outcrops in what is otherwise a very benign sea bed.

Experience from sea trials such as those described here has confirmed that acoustic reflectors as herein described (operating at a maximum response frequency of 120 kHz) will be detectable using commercial sonar systems out to ranges of at least 800 m. Reflectors according to the invention are therefore able to provide very effective and low cost means for marking the location of objects on or near to the sea bed.

It has been found convenient to manufacture the acoustic reflectors of this invention by making each reflector in two halves which are then adhered together. For spherical and ovoid reflectors the two halves are identical. A typical procedure is as follows. Half shells are first made by injection molding using a Zytel material (Zytel 151L NC010) which is a polyamide suitable for molding, supplied by DuPont. The molded shells are left for 24 hours and are then internally degreased. The interior of each half shell is then treated with a primer to encourage good adhesion with the core material (typically RTV silicone rubber) which is then poured in to fill the half shell. Suitable primers for use with these silicone rubber materials include products SS4004P, SS4044P, SS4120 or SS4155 available from GE Bayer. For RTV12 rubber the recommended primer is SS4004P with SS4044P or SS4155 as alternatives.

Each filled half shell is then left for a period of between 2 and 14 days at room temperature for the silicone core material to cure to a solid. It is convenient to use a catalyst to aid the curing process and to try and ensure that the minimum amount of byproduct is generated during the curing process; likewise a longer curing period assists with this. Suitable catalysts for this process include the products RTV12C 01P supplied by GE Bayer and TSE 3663B supplied by Momentive Performance Materials GmbH, Leverkusen.

Any slight shrinkage which occurs as a result of the curing of the silicone rubber material can be allowed for at this stage by topping up with further fresh core material and allowing this to cure. Once the filled half shells are fully prepared as described, an adhesive (such as Loctite 3425) is applied to the mating surfaces of the half shells and the two halves are brought into contact and clamped together then left for 14 days at room temperature for the adhesive to fully cure.

After the curing period each reflector is scanned (for example using a high resolution X-ray scanner) to check for voids or flaws in the reflector. Provided no voids or flaws are detected the scanned reflector units are then each calibrated in water over a frequency range of from 50 kHz to 900 kHz. This is done by interrogating each reflector unit with pulses from a sonar one after the other across the frequency band of interest. The reflected response is measured and plotted against frequency. These measurements are repeated for each position of rotation of the unit with respect to the sonar position, such positions being at intervals of 10° ' i.e. a total of 36 measurements. The reflector is then rotated through 90° in the other plane and the 36 measurements repeated. A calibration certificate setting out the performance characteristics of that reflector can then be prepared for each reflector device.

The invention claimed is:

1. An acoustic reflector comprising:

a core; and a shell having a wall arranged to surround said core, said shell having two separate acoustic windows in the shell wall, said shell transmitting acoustic waves incident on the shell wall into the core to be focused and reflected from an area of the shell wall located opposite to the area of incidence of the acoustic waves so as to provide a reflected acoustic signal output from the reflector, the core having a circular cross section and formed of one or more concentric layers of a solid material having a wave speed of from 840 to 1500 $ms^{-1}$, wherein incident acoustic waves are transmitted through the shell wall through said two separate acoustic windows in the shell wall along two separate paths into the core and the associated reflected acoustic signal outputs combine constructively to provide an enhanced acoustic signal output at one or more pre-determined frequencies.

2. An acoustic reflector according to claim 1 in which the core is in the form of one of a sphere and a right cylinder.

3. An acoustic reflector as claimed in claim 1, wherein the core is formed from a single solid material having a wave speed between 850 $ms^{-1}$ and 1300 $ms^{-1}$.

4. An acoustic reflector as claimed in claim 1, wherein the core is in the form of an ovoid.

5. An acoustic reflector as claimed in claim 1, wherein the core is formed from an elastomer material.

6. An acoustic reflector, as claimed in claim 5, wherein the elastomer material is a silicone rubber.

7. An acoustic reflector as claimed in claim 6 wherein the elastomer is one of an RTV12 silicon rubber and an RTV655 silicone rubber.

8. An acoustic reflector, as claimed in claim 1, wherein the rigid material is steel.

9. An acoustic reflector, as claimed in claim 1, wherein the rigid material is a glass reinforced plastics (GRP) material.

10. An acoustic reflector as claimed in claim 1 wherein the rigid material is one of a glass filled polyamide and a glass filled nylon.

11. An acoustic reflector as claimed in claim 1 wherein the signal output has a characteristic signature.

12. An acoustic reflector as in claim 11, wherein the characteristic signature is a characteristic time signature.

13. An acoustic reflector as in claim 1, wherein the wall is dimensioned relative to the core such that a portion of the acoustic waves incident on the shell are coupled into the shell wall and pass around the core within the shell and then are re-radiated to combine constructively with the internally reflected acoustic signal output.

* * * * *